United States Patent [19]

Torres

[11] 4,264,070

[45] Apr. 28, 1981

[54] PRACTICE APPARATUS FOR ALL TYPES OF BALL-GAMES

[76] Inventor: Rémy G. Torres, 1 rue de la Scie, Seyssinet Pariset, Isere, France

[21] Appl. No.: 82,077

[22] Filed: Oct. 5, 1979

[30] Foreign Application Priority Data

Oct. 5, 1978 [FR] France ..... 78 28950

[51] Int. Cl.[3] ..... A63B 69/40

[52] U.S. Cl. ..... 273/29 A; 273/127 C; 273/395; 273/407

[58] Field of Search ..... 273/127 C, 26 A, 29 A, 273/395, 127 R, 407, 181 F, 182 R, 29 R, 181 R, 181 U, 181 I

[56] References Cited

U.S. PATENT DOCUMENTS

| | | | |
|---|---|---|---|
| 4,072,295 | 2/1978 | Roberts | 273/26 A |
| 4,082,271 | 4/1978 | Martin | 273/26 A |
| 4,206,916 | 10/1980 | Epply | 273/26 A |

FOREIGN PATENT DOCUMENTS

| | | | |
|---|---|---|---|
| 347389 | 4/1931 | United Kingdom | 273/29 A |

*Primary Examiner*—Richard C. Pinkham
*Assistant Examiner*—T. Brown
*Attorney, Agent, or Firm*—Remy J. VanOphem

[57] ABSTRACT

A training net device for all types of ball games includes an inextensible net which is spread between a plurality of parallel rigid posts. The rigid posts are detachably attached by elastic binders to rigid elongated stiffeners on each side of the net. The stiffeners are pivotally connected in consecutive sequence. A locking mechanism for fixing the position of one of the stiffeners relative to an adjacent one is also disclosed. The locking mechanism includes a plurality of notches cooperatively engaging the pivotal connection. The device is then mounted to one of several disclosed support members.

16 Claims, 21 Drawing Figures

PRACTICE APPARATUS FOR ALL TYPES OF BALL-GAMES

FIELD OF THE INVENTION

The present invention pertains to an improved practice apparatus designed for all types of ball-games.

SUMMARY OF THE INVENTION

The scope of this invention is to produce a practice apparatus, that the sportsman can use to work alone seriously, and without having to run continuously after the balls, thus avoiding an unnecessary loss of time and strain.

According to the invention, the practice apparatus includes an inextensible net, spread between two rigid posts which are noticeably straight and parallel two by two. These posts are abutted and independant from one another along both opposite edges of the live part of the net. Both horizontal edges of the live part of the net are rigidly mounted on inextensible strings, that are respectively spread between two posts, and on two rigid stiffeners, one at each edge. The apparatus also includes elastic binders spread between the posts and the stiffeners. Each stiffener includes several elements, each one representing a post, and which are rigidly abutted with the binders, so as to be detachable. This apparatus is further characterized by the fact, that each binder includes, for each connection, a joining pin which is simultaneously engaged through a hole of each stiffener element. The length of one of these holes is larger, so as to allow an internal motion of the pin in parallel with the long axis of the stiffener element, in which this long hole is provided. Another characteristic of this apparatus is that a rivet is inserted on one of the stiffener elements, behind the hole housing the pin. This rivet can fit into a notch provided on the free end of the other stiffener element, in front of the hole housing the pin.

According to another specification of the invention, the pin consists of a bolt, which is rigidly mounted with a wing-nut.

According to another specification of the invention, the head of the rivet is positioned in such a fashion, that the free end of the other stiffener element may recess between the head of the rivet and the first stiffener element as the rivet comes to fit into a notch.

According to another specification of the invention, the stiffener elements consist of U-shaped sections, two adjacent elements being arranged in such a way, that their openings are directed opposite each other, so as to let the joining pin of the respective binder through the web of the said elements.

According to another specification of the invention, each stiffener element includes, along its flat web, a series of holes alternatively shaped as a regular C and as a reverse C when the respective element is in a vertical position. The elastic binders are inserted on the posts to form a series of loops, and each loop is connected to a stiffener element, in a detachable way, by overlapping the full portion limited between both ends of a C hole.

According to another specification of the invention, each stiffener is mounted on a detachable, folding base. This base includes a straight bar comprised of two elements of equal length, which are jointed together by a bolt and which can be locked together between the head of that bolt and a wing-nut tightened on this bolt. A portion of this bar includes a rivet, which recesses in a hole located in the other portion of the bar, as these portions of the bar are in prolongation of one another. The base also includes a detachable mount, which may consist of a bolt and a wing-nut, so as to mount the upper end of the bar on the respective stiffener, and a folding base plate mounted on the lower end of the bar.

According to another specification of the invention, the folding base plate includes a pad consisting of a U-shaped section pivoting on one end on the lower end of the bar, and a spacer which is jointed on the free end of the pad. The spacer is connected to the bar by a detachable pin. This spacer includes a U-shaped cross-section and a central web which grows wider from the end of the spacer, which is jointed to the pad. The detachable pin is parallel to both jointing pins, whereas after mounting of the assembly, the the edge of the pad extends flatly on the ground. The two pad ends, which receive the jointing pins, extend upward on either part of the bar and spacer, and the detachable pin crosses both edges of the spacer extending beyond the free end of the spacer wedge.

According to another specification of the invention, the practice apparatus includes anchor means consisting of pegs, that are driven into the ground and the lower base of the stiffeners; it also includes pegs, that are driven into the ground and the folding base plates, as well as span wires attached to the ground pegs and the stiffeners.

According to another version of the invention, an additional spacer is provided to connect both base plates.

According to another version of the invention, the anchoring means of the apparatus consists of straps, which are used to attach the upper part of each stiffener to a fixed post, and of pegs which are driven into the ground and into the lower part of the stiffeners.

According to another version of the invention, the anchoring means consist of bolts, which are used to attach the stiffeners to an independent cross-beam, which includes two parallel, horizontal bars, two parallel, vertical bars that are respectively mounted on the posterior ends of the horizontal bars, as well as one horizontal cross piece, at least, and mounted between the bars. In this manner, each stiffener has its lower end attached to the front end of an horizontal bar, and its upper end attached to the upper end of a vertical bar.

According to another specification of the invention, an additional inextensible string is provided in the lower and upper parts of the net. Each string extends between the posts, at a short distance from the inextensible string running the lower edge of the live part of the net.

The attached, schematic drawing provides a better understanding of the invention specifications.

DESCRIPTION OF THE PREFERRED EMBODIMENTS

Figure 1:
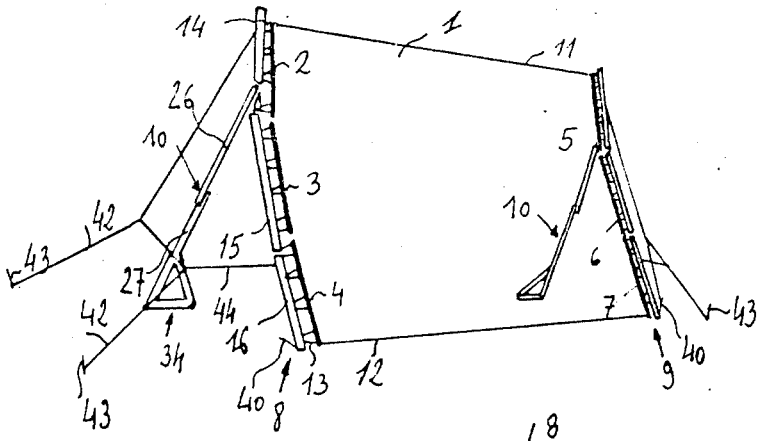
FIG. 1 is a general elevation view illustrating the practice apparatus designed according to the invention.

A practice apparatus designed according to the invention is represented on FIG. 1. This practice apparatus mainly includes an inextensible net 1, rigid posts 2 through 7, two rigid stiffeners 8 and 9, as well as two folding bases 10.

The inextensible net 1 is spread by the posts 2 through 7. These posts are noticeably straight and parallel two by two. They are abutted and independant from one another along both opposite edges of the live part of the net. Both horizontal edges of the live part of the net are rigidly mounted, respectively on an inextensible upper string 11 and on an inextensible lower string 12, each of them extending between two posts. The inextensible string 11 thus extends between the upper ends of posts 2 and 5, whereas the inextensible string 12 extends between the lower ends of posts 4 and 7.

Usually, each post can simply be routed through a row of meshes of the net, and each inextensible string can be simply routed through an horizontal row of meshes of the net. This arrangement is desirable, since it makes it possible to modify, at will, the dimensions of the live part of the net through a careful selection of the rows of meshes.

Figure 3:
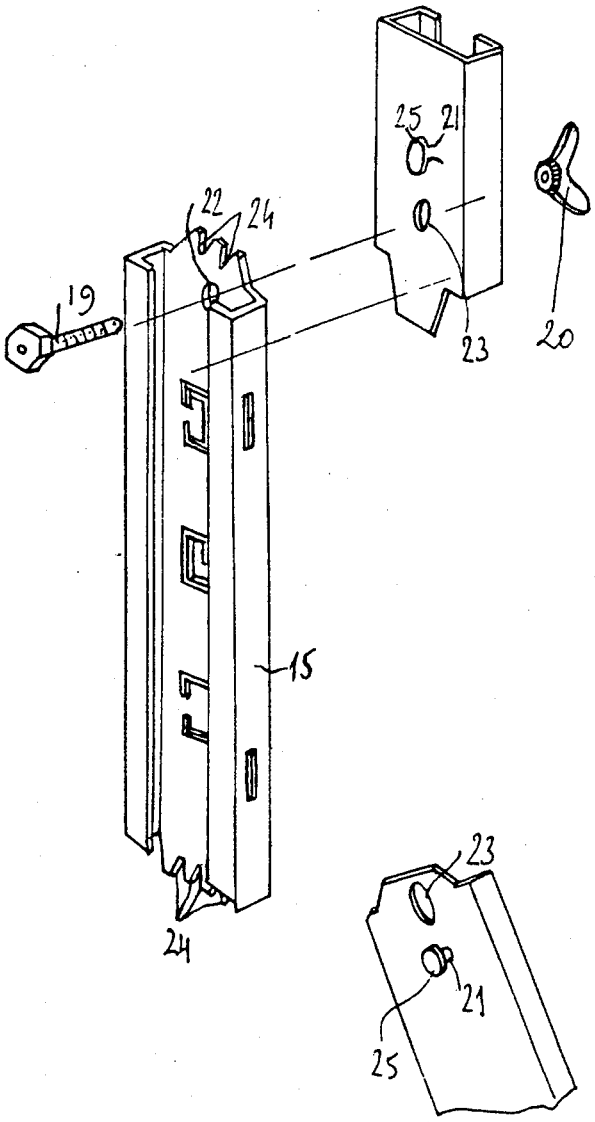
FIG. 3 is a partial, exploded view of a stiffener, as used in the practice apparatus illustrated in FIG. 1.
Figure 9:
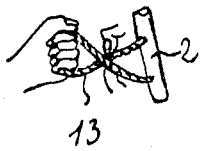
FIG. 9 is a view illustrating the installation of the elastic binders.

The posts are connected to the stiffeners 8 and 9 by the binders 13, which consist of a series of loops inserted in the posts. Each stiffener includes several elements, each one representing a post. Therefore, the elements 14, 15 and 16 of the stiffener 8 respectively coact with the posts 2, 3 and 4 respectively. Actually, these elements are U-shaped sections and therefore, they include a flat central web flanged by two parallel side edges (FIG. 3). Two adjacent elements are positioned in such a way that their openings be directed opposite each other. Each stiffener element includes, along its flat web, a series of openings 17 (FIG. 5) alternatively shaped as a regular C and as a reverse C when the said stiffener element is vertically oriented. Each loop of the elastic binder 13 may be connected to a stiffener element by overlapping the full portion 18 limited by both ends of the C-shaped opening as shown in FIGS. 4 and 9.

Figure 4:
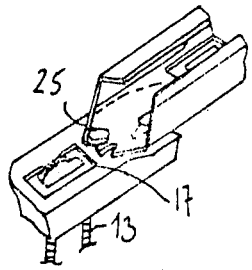
FIG. 4 is a partial elevation view of the assembled stiffener.
Figure 5:
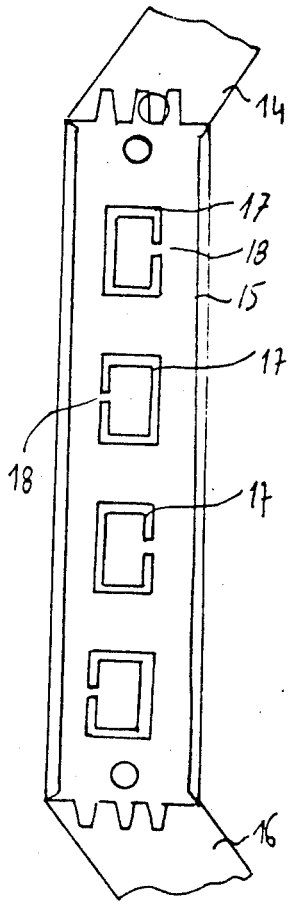
FIG. 5 is a partial view of the same stiffener.

The three elements of each stiffener, although detachable, are abutted together by means of connections which are shown in FIGS. 3 through 5. In each case, these connections include a bolt 19 solidly mounted with a wing-nut 20, and a rivet 21. The stem of bolt 19, which is used as a joining pin, is simultaneously engaged through a hole of each stiffener element. The hole 22, provided for this purpose in the middle element 15 of the stiffener, is a cylindrical hole. The matching hole 23 of the upper end element 14 or of the lower end element 16 of the stiffener, is drilled in parallel with the long axis of the stiffener element containing this long hole, so that the stem of bolt 19 may slide inside. Since the holes 22 and 23 are located in the central web of the stiffener elements, both central webs are gripped between the bolt head 19 and the wing-nut 20. For each connection, the rivet 21 is anchored on the end element of the stiffener, behind the long hole 23, and the stem of this rivet may fit into one of the notches 24 provided on the respective free end of the middle element 15 of the stiffener, in front of hole 22. In this case, the upper end of the stiffener element 15 includes two notches, whereas three notches are provided on its lower end; but the number of notches is not limited. The rivet 21 includes a head 25, so that the web of the stiffener element 15 may come to fit between that head 25 and the web of the adjacent stiffener element as the stem of rivet 21 fits into a notch 24.

Figure 2:
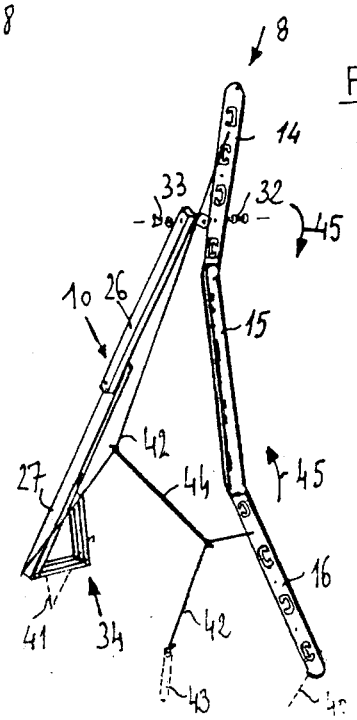
FIG. 2 is a partial, enlarged view of FIG. 1.
Figure 6:
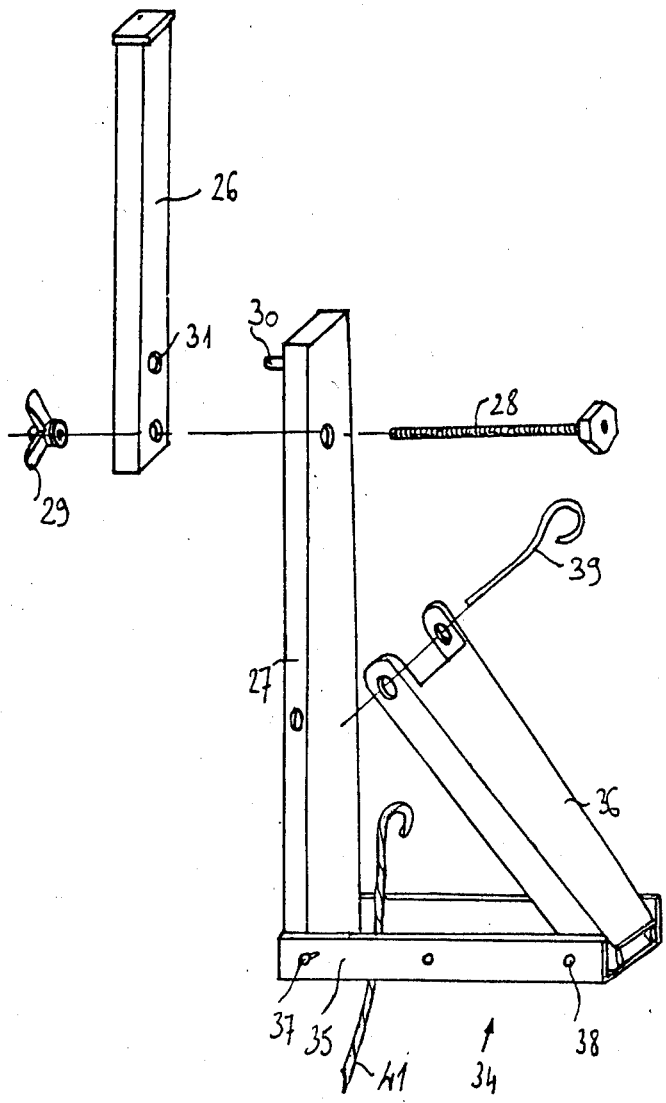
FIG. 6 is an exploded, elevation view of a folding base.

Each folding base 10 essentially includes a straight bar having an upper element or end 26 and a lower element or end 27, as well as a base plate 34 (FIGS. 1, 2 and 6). The elements 26 and 27 of the bar are jointed together by the stem of a bolt 28, and can be locked together, when gripped between the head of bolt 28 and a wing-nut 29 tightened on that bolt. The length of elements 26 and 27 is noticeably the same. The element 27 includes a rivet 30 which fits into a hole 31 of element 26 as the elements 26 and 27 are in prolongation. A detachable mount, which may consist of a bolt 32 and a wing-nut 33, is used to attach the upper end of the bar to the upper end 14 of the respective stiffener, using the holes provided in the bar and in the stiffener element in appropriate places.

The base plate 34 includes a base 35 and a spacer 36. The base 35 consists of a U-shaped section, with a central web and two side edges. Upon completion of the assembly, with the base 35 resting on the ground, has its side edges directed upward. The spacer 36 includes a U-shaped cross-section, but its two side edges come closer to one another along the said spacer, so that the latter includes a small lower end and a wide upper end. One end of base 35 is jointed on the lower end 27 of the bar by a pin 37 which is engaged through both side edges of the base. The other end of base 35 is jointed on the small lower end of the spacer 36, by a pin 38 which is parallel to pin 37, and which also passes through both side edges of base 35. It should be noted that these two side edges spread on either part of the lower end 27 of the bar and of the small lower end of spacer 36. A detachable pin 39 connects the wide upper end of spacer 36 to the lower end 27 of the bar. After the detachable pin 39 is installed, it is parallel with pins 37 and 38, and it passes through both side edges of spacer 36, which purposefully extend beyond the free end of the web of spacer 36, before it engages completely through the bar.

Finally, the practice apparatus includes anchor means which are: the pegs 40, which are driven into the ground and into the lower end of stiffeners 8 and 9 (FIG. 1); the pegs 41, which are driven into the ground and into the bases 35; and the wires 42, which are spread between the stiffeners and the pegs 43 which are driven into the ground. Each stiffener is preferably associated with two wires 42, which are joined together by a string 44 and attached in a middle point of each wire.

Figure 7:
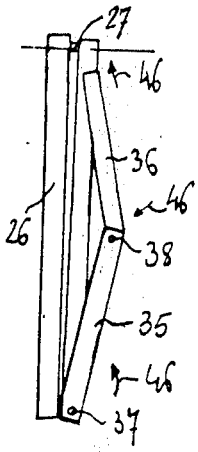
FIG. 7 is a side view of that base, when folded.
Figure 8:
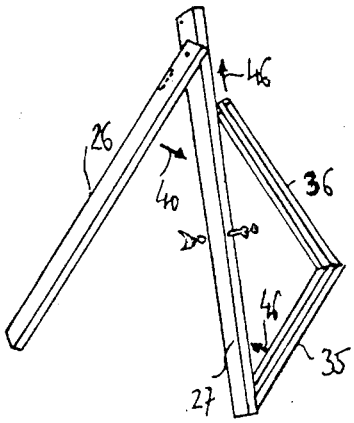
FIG. 8 is an elevation view of the folding base, half folded.

The above described practice apparatus can be entirely folded, including the base plates 10 and the stiffeners 8 and 9. In the transport position, the net 1 is thus rolled around the posts 2 through 7, whereas the rigid frame consisting of the base plates 10 and stiffeners 8 and 9, is folded in the following manner:

The three elements of each stiffener are folded back along each other (Arrows 45, FIG. 2). The base plates 10 are disjointed from the stiffeners after disassembly of the detachable mounts 32, 33, and then pulled back by folding the element 26 of the bar, the base 35 and the spacer 36 against the element 27 of that same bar, as illustrated by the arrows 46 of FIGS. 7 and 8, after having loosened the wing-nut 29 and extracted the detachable pin 39. Folded in that fashion, the assembly is very compact and can easily be transported in the trunk of a car for instance.

The reverse procedure is used to unfold the practice apparatus, the shape of the net 1 being defined by the selection of the notches 24 where the stem of the rivets 21 is to be engaged. In order to get from one notch to another, it is not necessary to completely disassemble the bolt 19 as shown in FIGS. 3 through 5. It is sufficient to loosen the wing-nut 20 and to spread apart the two applicable stiffener elements, so that the stem of bolt 19 may slide all the way to the front end of the long hole 23. Thereafter, the stem of rivet 21 is engaged in the appropriate notch 24, by pulling both stiffener elements closer together, the stem of bolt 19 sliding then to the rear end of the long hole 23.

In order to obtain a correct assembly of the frame, the base plates 35 should extend toward one another, and be parallel with the horizontal edges of the net 1, from the elements 26, 27 of the bar.

Figure 10:
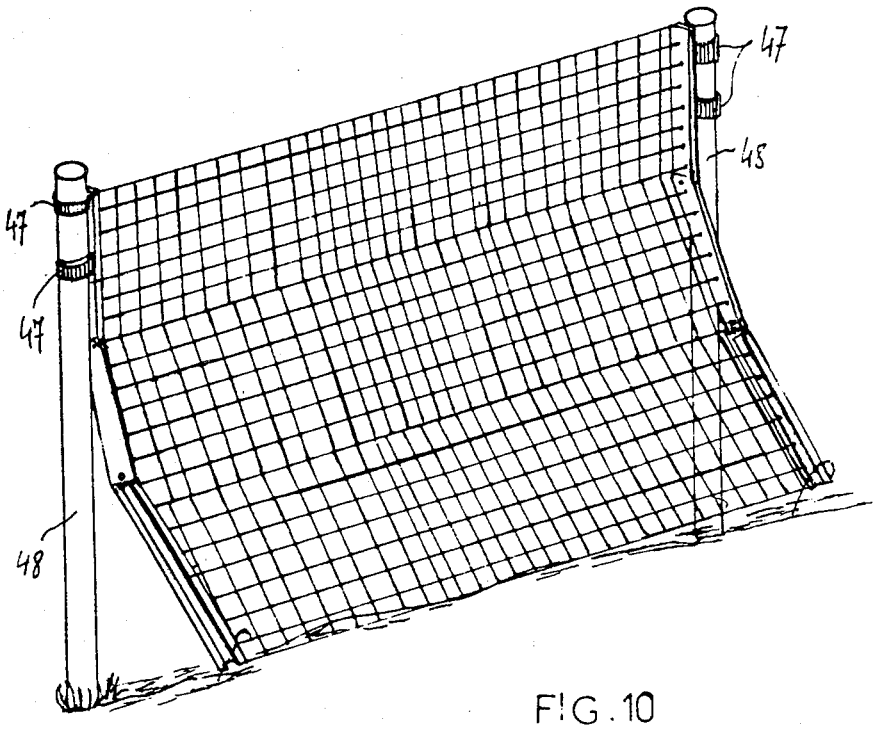
FIGS. 10 and 11 are two elevation views illustrating different versions of the practice apparatus invented.

In another version illustrated on FIG. 10, the anchor means may include, instead of the wires 42 and bases 20, straps 47 which are rigidly mounted on the upper stiffener elements. It is thus possible to attach each upper element of stiffener to a fixed post 48.

Figure 11:
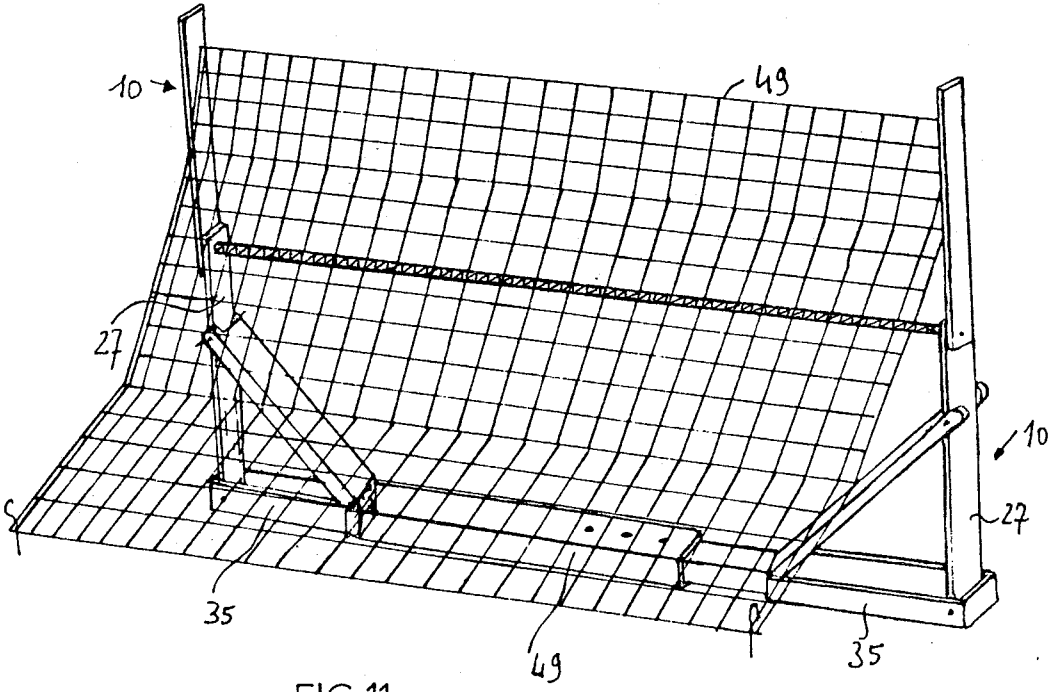

In another version illustrated on FIG. 11, both base plates 10 can be connected by two spacers 49, which are noticeably parallel with the horizontal edges of net 1. One of these spacers 49, is directly mounted between the lower elements 27 of the bars. The other spacer 49 is mounted between both bases 35, and in prolongation of those.

Figure 12:
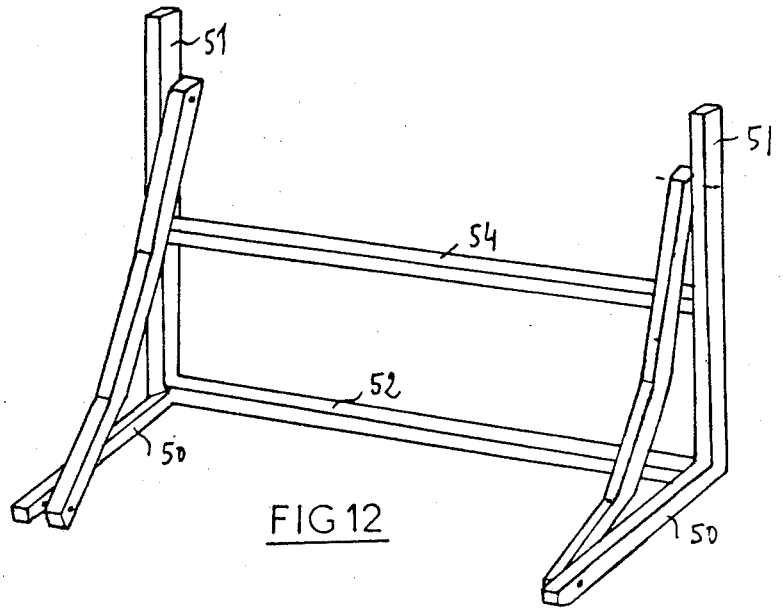
FIG. 12 is an elevation view illustrating the independent cross-beam used to anchor the practice apparatus invented.

In another version illustrated on FIG. 12, an independent cross-beam is used, which includes two parallel horizontal bars 50, and two parallel vertical bars 51, each one mounted on the rear end of one of the horizontal bars. An horizontal cross-tie 52 extends between both pairs of bars, and the lower end of each stiffener is attached to the front end of an horizontal bar, its upper end being attached to the upper end of a vertical bar; desirably, the attaching means consist of detachable bolts 53. Furthermore, the cross-beam may include an additional tie 54, rigidly mounted with the parallel vertical bars 51.

Figure 14:
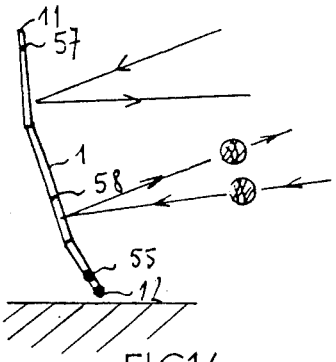
FIG. 14 is a cross-section of the net illustrated on FIG. 13.
Figure 15:
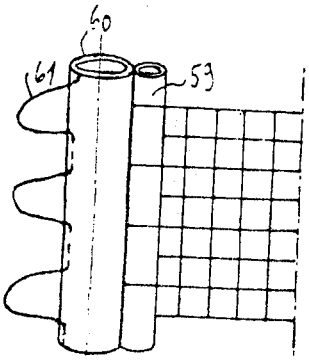
FIGS. 15 through 21 are partial front views of the practice apparatus, in other versions.

In another version illustrated on FIGS. 14 and 15, the lower part of the net 1 may include an additional inextensible string 55, close to the lower inextensible string 12, and spread likewise between the two lower posts 4 and 7 (Refer to FIG. 1). The fact that two inextensible strings are provided next to one another is particularly effective to prevent a ball 56 from rolling under the net. Likewise, an additional inextensible string 57 may be provided close to the upper inextensible string 11, so as to prevent the balls from flying above the net, as they reach the higher part of the latter.

The practice apparatus designed according to the invention can be used for soccer practice, either in the version illustrated on FIG. 1, with base plates 10 and wires 42, in the version illustrated on FIG. 10, with two fixed posts 48, or even in the case where the net 1 should be mounted inside a traditional goal, both posts of the goal being then used instead of the posts 48 of FIG. 10.

Figure 13:
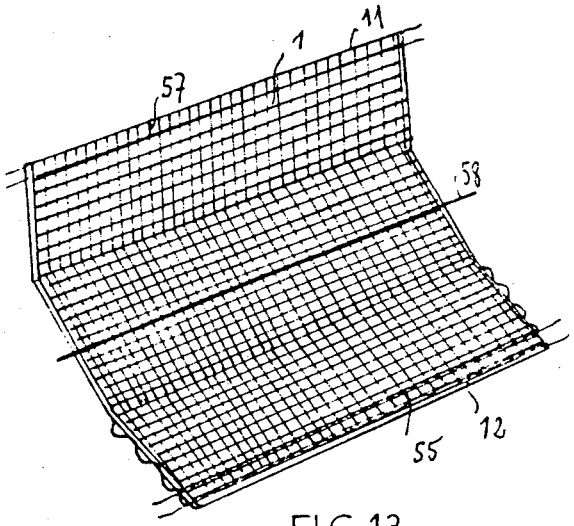
FIG. 13 is an elevation view of the net of the practice apparatus, in another version of the invention.

The practice apparatus may also be used for tennis practice, and it is then desirable to install an inextensible white string 58 along the middle part of the net (FIGS. 13 and 14), to simulate the upper edge of a traditional tennis net.

When an independant cross-beam, similar to that of FIG. 12 is used, the practice apparatus can be set in a gym. After practice hours, the assembly may be left on the cross-beam, and the latter can be stored in a corner of the room.

It should be noted that all versions have the following important specification in common: rigid components such as posts 2 through 7 and stiffeners 8 and 9 only, are placed along both vertical edges of net 1, the latter being never directly attached to a rigid, horizontal bar. In any case, therefore, the posts are the only rigid components of the practice apparatus, which are directly connected with the net 1.

It should also be noted that, when the net is installed on a cross-beam type structure (FIGS. 11 and 12), the stiffeners are preferably connected with the cross-beam by means which also allow a translation adjustment, so that the lower edge of the net may always remain adjacent to the ground, regardless of the shape of the net.

In the particular case as shown in FIG. 12, it is desirable to provide a system for the length adjustment of cross-ties 52 and 54. Actually, it is then possible to install the net as the cross-ties 52 and 54 are retracted, and then extend these cross-ties in order to spread the net.

In another version illustrated on FIG. 15, it is possible to use dual posts including two parts that are joined together, namely: a part 59 which engages in a vertical row of net meshes, and a tubular part 60 including an elastic binder 61 used to attach the post to the respective stiffener. The elastic binder 61 is routed through all of the holes provided in a row along the tubular part 60, so as to include a series of portions outside that tubular part.

The parts 59 and 60 may be connected by various means.

Figure 16:
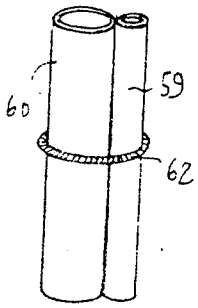

One or several rings 62 may be used to clamp both element parts 59 and 60 together (FIG. 16).

Figure 17:
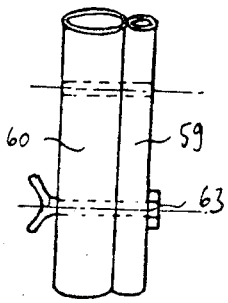
Figure 18:
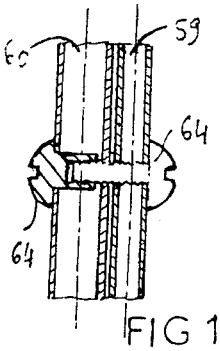
Figure 19:
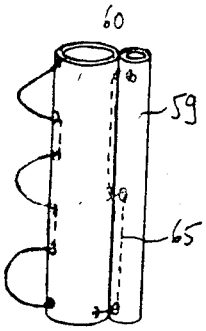
Figure 20:
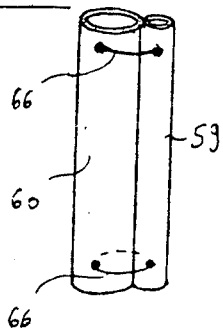
Figure 21:
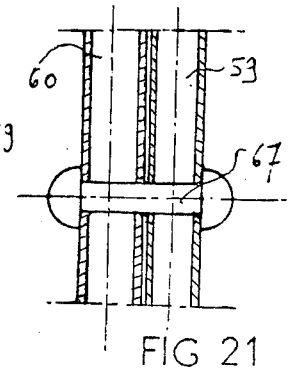

The parts 59 and 60 may also be joined together using through bolts 63 (FIG. 17), bushings 64 screwed inside one another (FIG. 18), a string 65 routed through both parts 59 and 60 (FIG. 19), laces 66 (FIG. 20) or plastic rivets 67 (FIG. 21).

This arrangement is particularly desirable in the case of small mesh type nets, such as tennis nets, because when mounting the elastic binder 61 directly in the post engaged through the meshes, it is difficult to introduce the portions of the elastic binder that are outside the post, through the meshes before they can be attached to the stiffener. Furthermore, this last procedure causes an undesirable distortion of the net at each external portion of the elastic binder.

The prime advantage of the apparatus invented, is that the sportsman may practice alone, seriously and without having to run after the balls, thus avoiding an unnecessary loss of time and strain.

This disadvantage is always present in the case of vertical practice walls used by tennis players to practice their service, thus sending the balls downward: the balls bounce on the wall, which automatically returns them downward. In the present case, even if the balls follow a downward curve 68 (FIG. 14) toward the net, they will be returned upward if the net is correctly tilted; the player can then hold a racquet in his right hand, while using the left hand to catch the balls.

While the invention heretofor has been described with a preferred embodiment and other advantageous alternate embodiments, it will be understood that it is not intended to limit the invention to those embodiments. On the contrary, it is intended to cover all alternatives, modifications and equivalents as may be included within the spirit and scope of the invention as defined by the appended claims.

What is claimed is:

1. A training device for ball games, said device for mounting to a support structure, said device comprising:

an inextensible net having a first end and a second end, said first end having a first row of mesh and said second end having a second row of mesh;

a plurality of first elongated rigid upright members engaged through said first row of mesh, said plurality of said first upright members being aligned end to end along said first end of said net;

a plurality of second elongated rigid upright members engaged through said second row of mesh, said plurality of said second upright members being aligned end to end along said second end of said net;

first means for stiffening said device comprising:

a plurality of first rigid elongated stiffeners;

first means for pivotally connecting said plurality of first stiffeners in consecutive sequence; and first means for elastically attaching each of said plurality of first stiffeners to a corresponding one of said plurality of first upright members;

second means for stiffening said device, comprising:

a plurality of second rigid elongated stiffeners;

second means for pivotally connecting said plurality of second stiffeners in consecutive sequence; and second means for elastically attaching each of said plurality of second stiffeners to a corresponding one of said plurality of second upright members;

first locking means for fixing the position of at least one of said first stiffeners relative to an adjacent one of said first stiffeners, said first locking means comprising a first plurality of notches on one end on said adjacent one of said first stiffeners, said first plurality of notches cooperatively engaging said first pivotally connecting means to adjustably connect said at least one of said first stiffeners relative to said adjacent one of said first stiffeners;

second locking means for fixing the position of at least one of said second stiffeners relative to an adjacent one of said second stiffeners, said second locking means comprising a second plurality of notches on one end on said adjacent one of said second stiffeners, said second plurality of notches cooperatively engaging said second pivotally connecting means to adjustably connect said at least one of said second stiffeners relative to said adjacent one of said second stiffeners; and means for mounting said device to said support structure.

2. A sportsman's training device for ball games, said device comprising:

an inextensible net having a first end and a second end, said first end having a first row of mesh and said second end having a second row of mesh;

a plurality of first elongated rigid upright members engaged through said first row of mesh, said first upright members being aligned end to end along said first end of said net;

a plurality of second elongated rigid upright members engaged through said second row of mesh, said second upright members being aligned end to end along said second end of said net;

first means for stiffening said device, comprising:

a plurality of first rigid elongated stiffeners;

first means for pivotally connecting said plurality of first stiffeners in consecutive sequence; and first means for elastically attaching each of said plurality of first stiffeners to a corresponding one of said plurality of first upright members;

second means for stiffening said device, comprising:

a plurality of second rigid elongated stiffeners;

second means for pivotally connecting said plurality of second stiffeners in consecutive sequence; and second means for elastically attaching each of said plurality of second stiffeners to a corresponding one of said plurality of second upright members;

first locking means for fixing the position of at least one of said first stiffeners relative to an adjacent one of said first stiffeners, said first locking means comprising a first plurality of notches on one end on said adjacent one of said first stiffeners, said first plurality of notches cooperatively engaging said first pivotally connecting means to adjustably connect said at least one of said first stiffeners relative to said adjacent one of said first stiffeners;

second locking means for fixing the position of at least one of said second stiffeners relative to an adjacent one of said second stiffeners, said second locking means comprising a second plurality of notches on one end on said adjacent one of said second stiffeners, said second plurality of notches cooperatively engaging said second pivotally connecting means to adjustably connect said at least one of said second stiffeners relative to said adjacent one of said second stiffeners; and a support structure connected to at least one of said plurality of first rigid elongated stiffeners and at least one of said plurality of second rigid elongated stiffeners to support said device for use by a sportsman.

3. A training device as claimed in claim 2, wherein said support structure is detachably connected to said device.

4. A training device as claimed in claim 2, wherein said support structure further comprises:

at least one base plate member having one end and an opposite end;

at least one vertical member mounted adjacent to said at least one base plate member, said at least one vertical member having a first end and a second end opposite said first end, said first end of said at least one vertical member connected to said one end of said at least one base plate member, said second end connected to said at least one of said plurality of first and second elongated stiffeners; and at least one spacer member mounted adjacent to said at least one vertical member and to said at least one base plate member, said at least one spacer member having one end and an opposite end, said opposite end of said at least one spacer member connected to said opposite end of said at least one base plate member, said one end of said at least one spacer member connected to said at least one vertical member between said first end and said second end.

5. A training device as claimed in claim 4, wherein said support structure further comprises:

at least one other base plate member having one end and an opposite end;

at least one other vertical member mounted adjacent to said at least one other base plate member, said at least one other vertical member having a first end and a second end opposite said first end, said first end of said at least one other vertical member connected to said one end of said at least one other base plate member, said second end connected to said at least one other of said plurality of first and second elongated stiffeners; and at least one other spacer member mounted adjacent to said at least one other vertical member and to said at least one other base plate member, said at least one other spacer member having one end and an opposite end, said opposite end of said at least one other spacer member connected to said opposite end of said at least one other base plate member, said one end of said at least one other spacer member connected to said at least one other vertical member between said first and second ends.

6. A training device as claimed in claim 5, further comprising:

means for detachably connecting each of said plate members to said vertical members and to said spacer members so as to permit folding and storing of said support structure.

7. A training device as claimed in claim 5, wherein said support member further comprises:

a first horizontal tie bar having one end and an opposite end, said one end of said first horizontal tie bar connected to said opposite end of said at least one of said base plate member, said opposite end of said first horizontal tie bar connected to said opposite end of said at least another of said base plate member; and a second horizontal tie bar connecting said at least one of said vertical members with said at least another of said vertical members.

8. A training device as claimed in claim 2, wherein each of said plurality of first and second elongated stiffeners further having a U-shaped central portion extending from one end to the other end.

9. A training device as claimed in claim 8, wherein said U-shaped central portion further having portions defining at least one C-shaped opening and at least one reverse C-shaped opening adjacent said at least one C-shaped opening.

10. A training device as claimed in claim 2, further comprising means for anchoring said support structure to the ground.

11. A training device as claimed in claim 2, further comprising:

means for anchoring said support structure and at least one of said plurality of first and second rigid elongated stiffeners to the ground.

12. A training device as claimed in claims 1 or 2, wherein each of said plurality of first and second rigid elongated stiffeners further having a central web portion extending from one end to the other end, a pair of parallel edge members mounted on each side of said central web portion to form a U-shaped central web portion, said central web portion having portions defining a plurality of C-shaped openings.

13. A training device as claimed in claim 2, wherein said plurality of first rigid upright members further being aligned one adjacent to another to form at least one pair of plurality of first rigid upright members, said at least one pair of said plurality of first rigid upright members further being aligned but unconnected end to end to at least another pair of said plurality of first rigid upright members along said first end of said net and wherein said plurality of second rigid upright members further being aligned one adjacent to another to form at least one pair of plurality of second rigid upright members, said at least one pair of said plurality of second rigid upright members further being aligned but unconnected end to end to at least another pair of said plurality of second rigid upright members along said second end of said net.

14. A training device as claimed in claim 13 further comprising:

means for joining each pair of plurality of rigid upright members.

15. A training device as claimed in claim 1 or 2 further comprising:

a white inextensible string connected perpendicular to one of said plurality of said first upright members and one of said plurality of said second upright members and extending across said inextensible net.

16. A training device as claimed in claim 2, wherein said support structure further comprises:

a pair of parallel horizontal bars, each of said pair of horizontal bars having a first end and a second end;

a pair of parallel vertical bars, each of said pair of vertical bars rigidly mounted at one end to said first end of each of said pair of horizontal bars;

a first horizontal tie bar connecting said first end of one of said pair of horizontal bars to said first end of another of said pair of horizontal bars; and a second horizontal tie bar connecting one of said pair of vertical bars to the other of said pair of vertical bars.

* * * * *

UNITED STATES PATENT OFFICE

CERTIFICATE OF CORRECTION

Patent No. 4,264,070 Dated April 28, 1981

Inventor(s) Remy G. Torres

It is certified that error appears in the above-identified patent and that said Letters Patent are hereby corrected as shown below:

Column 2, line 16, delete the word "the" second occurrence.

Column 2, line 45, delete the word "an" and insert ----a----.

Column 4, line 60, after the numeral "42;" delete the word "which".

Column 5, line 47, delete the word "an" and insert ----a----.

Column 5, line 49, delete the word "an" and insert ----a----.

Column 5, line 55, delete "14 and 15" and insert ----13 and 14----.

Signed and Sealed this

*Sixth* Day of *October 1981*

[SEAL]

*Attest:*

GERALD J. MOSSINGHOFF

*Attesting Officer*

*Commissioner of Patents and Trademarks*